US005806942A

United States Patent [19]

Jenkins, Jr. et al.

[11] Patent Number: 5,806,942

[45] Date of Patent: Sep. 15, 1998

[54] DISHWASHER DOOR AND DECORATOR PANEL ASSEMBLY

[75] Inventors: Joseph L. Jenkins, Jr., Greenville; David R. Harris, Kinston, both of N.C.

[73] Assignee: White Consolidated Industries, Inc., Cleveland, Ohio

[21] Appl. No.: 773,985

[22] Filed: Dec. 26, 1996

[51] Int. Cl.[6] ..... A47B 97/00

[52] U.S. Cl. ..... 312/204; 312/265.6

[58] Field of Search ..... 312/204, 257.1, 312/265.6, 138.1; 49/501

[56] References Cited

U.S. PATENT DOCUMENTS

| | | | |
|---|---|---|---|
| 653,514 | 7/1900 | Kasschau . | |
| 881,679 | 3/1908 | Gros . | |
| 2,227,761 | 1/1941 | Roethel . | |
| 2,324,710 | 7/1943 | Livar . | |
| 2,708,529 | 5/1955 | Lander et al. . | |
| 3,180,697 | 4/1965 | Mulch . | |
| 3,228,736 | 1/1966 | Beckerman . | |
| 3,294,461 | 12/1966 | Barnard et al. | 312/204 |
| 3,338,649 | 8/1967 | Stewart . | |
| 3,419,933 | 1/1969 | Gossen . | |
| 3,428,385 | 2/1969 | Scott . | |
| 3,779,177 | 12/1973 | Gigante . | |
| 3,779,624 | 12/1973 | Werderitsch . | |
| 3,851,939 | 12/1974 | Benasutti et al. . | |
| 3,866,824 | 2/1975 | Lewis . | |
| 3,936,107 | 2/1976 | Gourdeau et al. . | |
| 3,955,863 | 5/1976 | Yellin . | |
| 4,009,796 | 3/1977 | Schmidt . | |
| 4,214,797 | 7/1980 | Borresen et al. . | |
| 4,229,921 | 10/1980 | Schell . | |
| 4,290,660 | 9/1981 | Brezosky . | |
| 4,438,993 | 3/1984 | Rabas . | |
| 4,448,463 | 5/1984 | Amos . | |
| 4,531,387 | 7/1985 | Cotton et al. . | |
| 4,618,193 | 10/1986 | Cuthbert et al.j . | |
| 4,708,895 | 11/1987 | Mizusawa . | |
| 4,732,431 | 3/1988 | Mason . | |
| 4,854,017 | 8/1989 | Kamp . | |
| 4,865,366 | 9/1989 | Kretchman . | |
| 4,875,745 | 10/1989 | Trulaske . | |
| 4,896,926 | 1/1990 | Verholt . | |
| 4,900,109 | 2/1990 | Boston, Jr. et al. . | |
| 5,158,346 | 10/1992 | Marks et al. . | |
| 5,161,343 | 11/1992 | Edwards et al. . | |
| 5,496,104 | 3/1996 | Arnold et al. . | |
| 5,645,331 | 7/1997 | Eddy et al. | 312/204 |

FOREIGN PATENT DOCUMENTS

| | | |
|---|---|---|
| 2454777 | 11/1980 | France . |
| 1445862 | 8/1976 | United Kingdom . |

*Primary Examiner*—Peter R. Brown
*Assistant Examiner*—Gerald A. Anderson
*Attorney, Agent, or Firm*—Pearne, Gordon, McCoy and Granger LLP

[57] ABSTRACT

Disclosed is a dishwasher door and panel assembly including one or more decorator panels that are retained between two vertical flanges along the front of a dishwasher. The assembly includes a brace member and a trim piece that extend along the bottom periphery of the dishwasher door. The decorator panels are removed by releasing the trim piece from the brace member and sliding one or more of the panels out of engagement from the front of the dishwasher door.

16 Claims, 4 Drawing Sheets

DISHWASHER DOOR AND DECORATOR PANEL ASSEMBLY

FIELD OF THE INVENTION

The present invention relates to a dishwasher door and removable panel assembly. The panel may be easily removed and replaced along the front of the dishwasher door. The present invention assembly enables panels of different colors and styles to be selectively displayed at the front of the dishwasher.

BACKGROUND OF THE INVENTION

Interchangeable door panels for appliances are known in the art. For instance, U.S. Pat. No. 4,732,431 to Mason, herein incorporated by reference, discloses interchangeable door panels for a dishwasher. However, Mason affixes the door panels to the front door of a dishwasher by using a retaining strip and a plurality of screws or snap-fit connectors. Thus, replacement of the door panel requires removing the retaining strip and fasteners, changing the panel, aligning each fastener, i.e. screw or snap-fit connector, with its respective aperture in the door, and reattaching all the fasteners. This lengthy procedure increases the complexity of the panel replacement operation and detracts from the advantages of using an interchangeable door panel.

Furthermore, there are other disadvantages associated with using snap-fit connectors to releasably retain a panel to the front of the dishwasher door. Utilizing multiple snap-fit connectors significantly increases the cost of designing, manufacturing and assembling a door and panel assembly. One or more components providing the various snap-fit connectors must be incorporated in the door assembly. Moreover, for each snap-fit connector, an aperture or receiving receptacle must be provided. Mason provides such apertures along a portion of the dishwasher door. This further adds to the cost of designing, manufacturing, and assembling a door and panel combination. If one or more snap-fit connectors fracture or break, it is necessary to replace the broken connectors or the components providing the connectors, which typically include a retaining strip or other door component.

Thus, there is a need for an economical door and panel assembly in which the panel may be easily and quickly replaced. Moreover, there is a need for a simplified and economical design for an interchangeable panel assembly such as for an appliance, and specifically for the front door of a dishwasher. In addition, there is a need for a door and panel assembly which is not susceptible, or at least significantly less susceptible, to various connectors breaking or fracturing and thus is very durable as compared to known assemblies.

SUMMARY OF THE INVENTION

The present invention achieves all of the foregoing objectives and provides in one aspect, an appliance door and interchangeable panel assembly comprising a door frame having a plurality of frame members and a pair of flanges, a middoor panel extending over the frame members and providing a lower edge, a brace member affixed to the middoor panel and disposed along the lower edge, a trim piece releasably engaged to the brace member, and an interchangeable decorator panel disposed between the flanges and supported on the trim piece.

In yet another aspect, the present invention provides a dishwasher having an interchangeable front panel assembly along the dishwasher front door. The dishwasher comprises the previously noted brace member and releasable trim piece to support the panel along the front of the door.

In yet another aspect, the present invention comprises a method of replacing an interchangeable panel positioned along the front of an appliance door by releasing the previously noted trim piece from the brace member, and sliding the panel out from the door. The same or a second panel may then be placed along the front of the appliance door.

DESCRIPTION OF THE PREFERRED EMBODIMENTS

Figure 1:
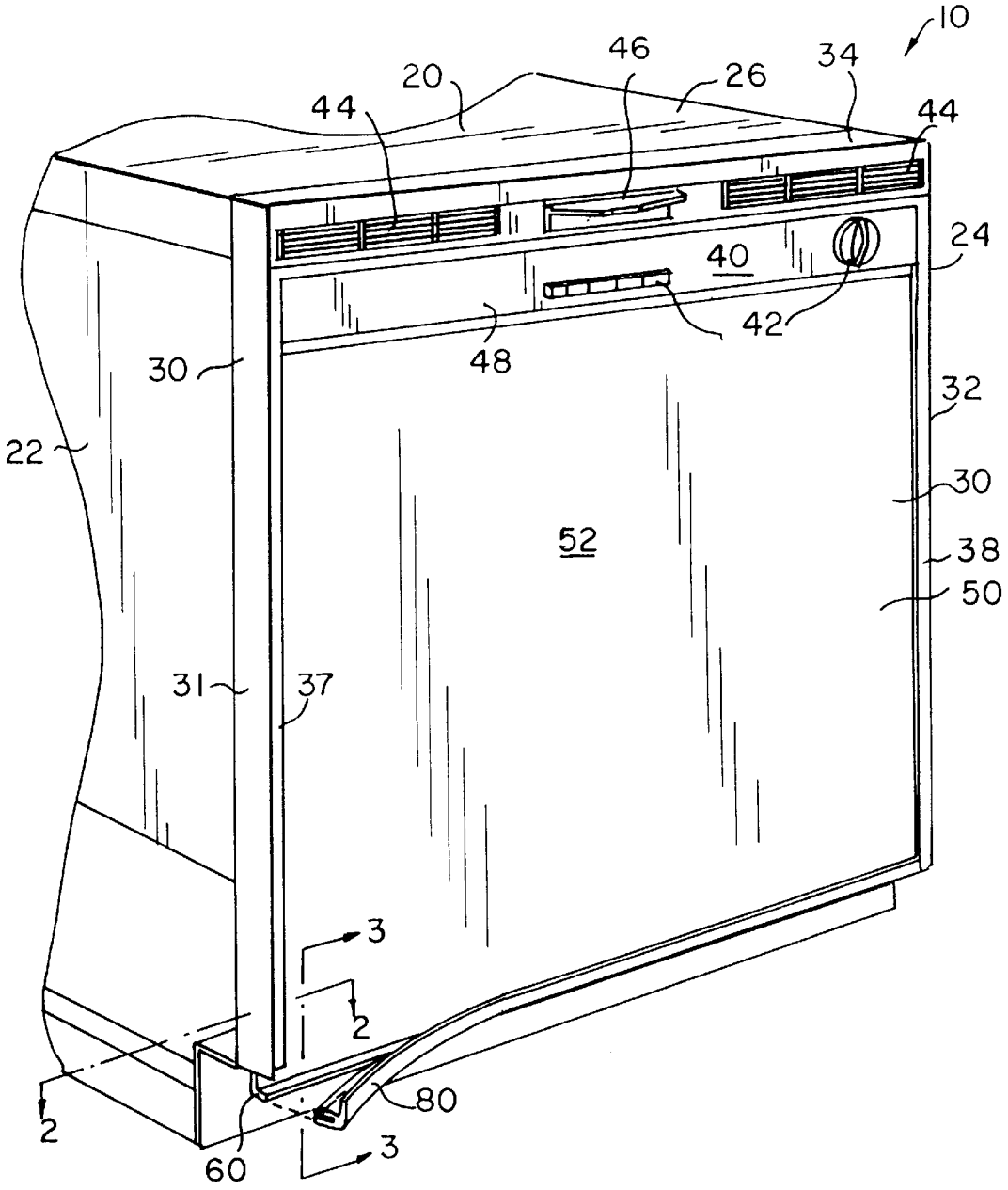
FIG. 1 is a partial perspective view of a first preferred embodiment dishwasher, illustrating the decorator panel assembly of the present invention.

FIG. 1 illustrates a preferred embodiment dishwasher and door assembly 10. The dishwasher 10 comprises an enclosure 20, a door 30, a console 40, a decorator panel 50 disposed along the front of the door 30, and a brace member 60 and a trim piece 80 that generally support and releasably retain the decorator panel 50 along the front of the door 30.

The dishwasher enclosure 20 generally provides a first side 22, a second side 24, and a top surface 26 extending therebetween. The door 30 is pivotally attached to the dishwasher enclosure 20 or frame by one or more hinges as known in the art. The door 30 provides a first side 31, a second side 32, and a top surface 34 extending therebetween. The door 30 further includes two flanges 37 and 38 extending vertically along each side 31 and 32 of the door 30. The first flange 37 generally extends along a first side 31 from the underside of the console 40 to the bottom portion of the door 30. Similarly, the second flange 38 extends along the second side 32 of the door 30, from the bottom of the console 40 to the bottom of the door 30. Each flange 37 and 38 provides a rearwardly directed seating surface, preferably extending along the length of the flange, for contacting and slidable engaging the panel 50. References to "front" and "rear" are generally with respect to a dishwasher. Accordingly, a frontward direction is that direction which the front of the dishwasher faces, and a rearward direction is opposite, and so, the direction which the rear of the dishwasher faces.

The console 40 generally includes one or more controls 42, one or more vents 44, a handle 46, and a front face 48. The console 40 is preferably disposed proximate the upper periphery of the door 30 as shown in FIG. 1. It will be understood that a variety of console configurations can be utilized.

The dishwasher 10 comprises the previously noted decorator panel 50 disposed along the front face of the dishwasher door 30. The decorator panel 50 includes a front surface 52 which may be colored or contain a decorative pattern as described in greater detail below. As illustrated in FIG. 1, the decorator panel 50 preferably extends between the flanges 37 and 38 and also extends vertically between the console 40 and the bottom of the door 30.

The decorator panel 50 and related panels described herein, are generally retained and supported by a brace member 60 and a trim piece 80. The brace member 60 extends horizontally along the bottom periphery of the dishwasher door 30. The trim piece 80 is separate from the brace member 60 and releasably engages the brace member 60 to support the decorator panel 50 and its related panels along the front face of the door 30.

Figure 2:
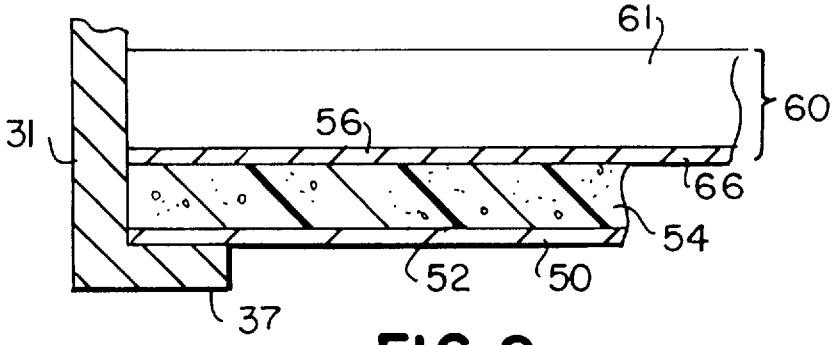
FIG. 2 is a partial cross-sectional view taken along line 2—2 in FIG. 1.

As shown in FIG. 2, the collection of panels retained along the front face of the dishwasher door 30 typically includes the decorator panel 50, oriented so that its front surface 52 is directed outward, i.e. in the same direction as that which the front of the dishwasher faces, a spacer panel 54, and a middoor panel 56. The panels 50, 54, and 56 are preferably retained between the dishwasher door sides 31 and 32, and most preferably between the flanges 37 and 38. The middoor panel 56 is affixed to suitable frame or mounting components of the dishwasher door 30 so that it is essentially fixed or integral with the door 30. As described in greater detail below, the brace member 60 is preferably affixed to the middoor panel 56. The spacer panel 54 is preferably affixed to the middoor panel 56, such as by adhesive bonding. However, it is within the scope of the present invention, particularly this first preferred embodiment, to utilize a free, non-attached spacer panel along the front of the dishwasher door, positioned behind the decorator panel 50.

The decorator panel 50 may be formed from a wide array of materials including but not limited to metals, plastics, cellulose-based materials, various composite materials, and combinations thereof. The spacer panel 54 is typically formed from a flexible foamed polymeric material as known in the art. Other materials may be used for the spacer panel 54 including for instance pressed cellulose-based materials. The middoor panel 56 is preferably a relatively rigid thin material. Suitable materials for the middoor panel 56 include metals.

The decorator panel 50 provides, preferably along the front surface 52, a decorative finish, color, combination of colors, pattern, or other visual indicia. It is most preferred to provide along with the dishwasher 10, a plurality of panels 50, each having a different color, combination of colors, patterns or finish, so that depending upon the environment or decor of the installation site, e.g. a kitchen, a decorator panel 50 having an appropriate color or combination of colors, or pattern or finish, can be placed along the front of the dishwasher door 30. This may be desirable in order to match the dishwasher with its surroundings. Examples of patterns or finishes that may be formed, printed, or otherwise applied onto the front surface 52 of a panel 50 include, but are not limited to, a wood finish, a brushed stainless steel finish, a high gloss finish, a satin finish, a mirrored finish, and/or a wide array of patterns or different colors. Instead of applying the desired colors or patterns onto the front surface 52 of the panel 50, it is possible to incorporate such colors or patterns directly into the panel 50. Furthermore, it is contemplated that a different finish, color, combination of colors, pattern, or other visual indicia could be provided on the rear surface of the decorator panel 50.

FIG. 2 also illustrates the brace member 60 generally extending along the bottom periphery of the door 30 and affixed to the rearward facing surface of the middoor panel 56. As illustrated in FIG. 2, it is preferred that the side edges of the panels 50, 54, and 56 abut against the inward facing side of the door side 31. It is most preferred that the outer periphery of the panel 50, particularly those regions along the sides of the front surface 52, contact the rearward seating surface of each flange 37 and 38. This configuration promotes secure retention of the panels 50, 54, and 56.

Figure 3:
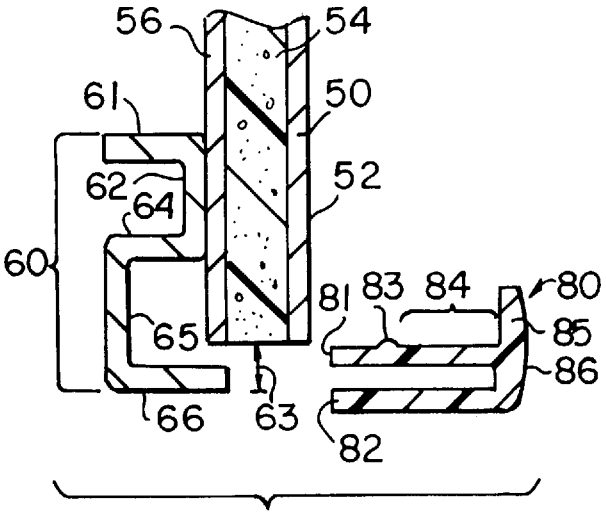
FIG. 3 is another partial cross-sectional view taken along line 3—3 in FIG. 1.

FIG. 3 is a partial cross-sectional view of the panels 50, 54, and 56, the brace member 60, and the trim piece 80 configuration shown in FIG. 1. It can be seen that the brace member 60 is affixed to the rearward facing surface of the middoor panel 56 and extends below the bottom periphery of the middoor panel 56. The cross-sectional profile of the brace member 60 is generally S-shaped and comprises an upper ledge 61, a midledge 64, and a lower ledge 66. These ledges 61, 64, and 66, are preferably parallel to one another. When the brace member 60 is affixed to the middoor panel 56, all ledges 61, 64, and 66 are preferably perpendicular to the panel 56. Extending between the upper ledge 61 and the midledge 64 is a transversely oriented mounting base 62. Likewise, extending between the midledge 64 and the lower ledge 66 is a transversely oriented end wall 65. The brace member 60 is affixed to the rearward facing surface of the middoor panel 56 along the vertical mounting base 62. The method of affixment depends upon the materials utilized for the panel 56 and the mounting base 62, but includes for instance, welding, brazing, and adhesive bonding. It is contemplated that the brace member 60 could be integrally formed with the panel 56. Referring to FIG. 3, the end wall 65 extends downward below the lower portion of the middoor panel 56 a distance 63. Moreover, the lower ledge 66 projects toward the panel 50 slightly beyond both the upper ledge 61 and the midledge 64. The lower ledge 66 preferably projects in the same direction as that which the front of the dishwasher faces, and projects a distance equivalent to the thickness of the middoor panel 56. This configuration is shown in FIG. 2. A portion of the lower ledge 66 extends forwardly beyond the upper ledge 61, to a location laying approximately within the same plane as the middoor panel 56, and specifically, to the front face of the middoor panel 56.

The trim piece 80 is shown in FIG. 3 apart from and not engaged with the brace member 60. The trim piece 80 releasably engages the brace member 60 and lower periphery of the dishwasher door 30 to enable a panel such as the decorator panel 50 to be retained along the front of the door 30. The preferred cross-sectional profile of the trim piece 80 is in the shape of an inverted F, having two generally parallel legs, e.g. an upper leg 81 and a lower leg 82, that project from a transversely oriented rail 85. The rail 85 provides a finished face 86. When engaged with the brace member 60, the trim piece 80 is oriented so that its legs 81, 82 project toward the dishwasher 10, and its finished face 86 faces outward in the same direction as that which the front of the dishwasher faces. The upper leg 81 provides a raised detent 83 formed along its upwardly facing surface. The detent 83 is formed at a location along the length of the upper leg 81, as measured from the rail 85, a distance 84 from the vertical rail 85. This distance 84 corresponds to the width of the panel or panels disposed along the front of the door 30, which typically include the middoor panel 56, the spacer panel 54, and the decorator panel 50.

The trim piece 80 is releasably engaged with the brace member 60 by inserting the lower ledge 66 of the brace member 60 between the upper leg 81 and the lower leg 82 of the trim piece 80 until the detent 83 of the trim piece 80 is positioned behind the middoor panel 56. In this configuration, the rail 85 of the trim piece 80 preferably contacts the decorator panel 50 and thereby secures it to the front of the dishwasher door 30. The trim piece 80 also supports the decorator panel 50 and any other free, i.e. unattached, panels disposed alongside the panel 50. The panels are supported by the trim piece 80 along the distance or region 84. Generally, the decorator panel 50 is disposed upon at least a portion of the trim piece, and specifically within the region or distance 84. It is preferred that the panel 50 contact the trim piece 80 within at least a portion of this region or distance 84.

Figure 4:
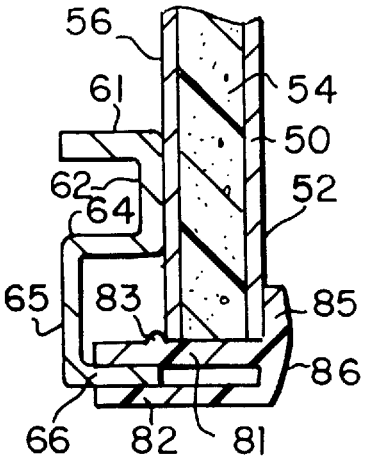
FIG. 4 illustrates the assembled components depicted in FIG. 3.

FIG. 4 illustrates the assembly of FIG. 3 upon completed engagement. As a result of engagement, the front surface 52 of the panel 50 contacts the rearward surface of the rail 85. The bottom edges of the panels 50, 54, and 56 preferably contact the upward facing surface of the leg 81, and specifically along the distance 84 of the trim piece 80. As noted, the lower ledge 66 of the brace member 60 is inserted between the upper and lower legs 81 and 82 of the trim piece 80. Furthermore, the detent 83 is in contact with the rearward surface of the middoor panel 56.

Figure 5:
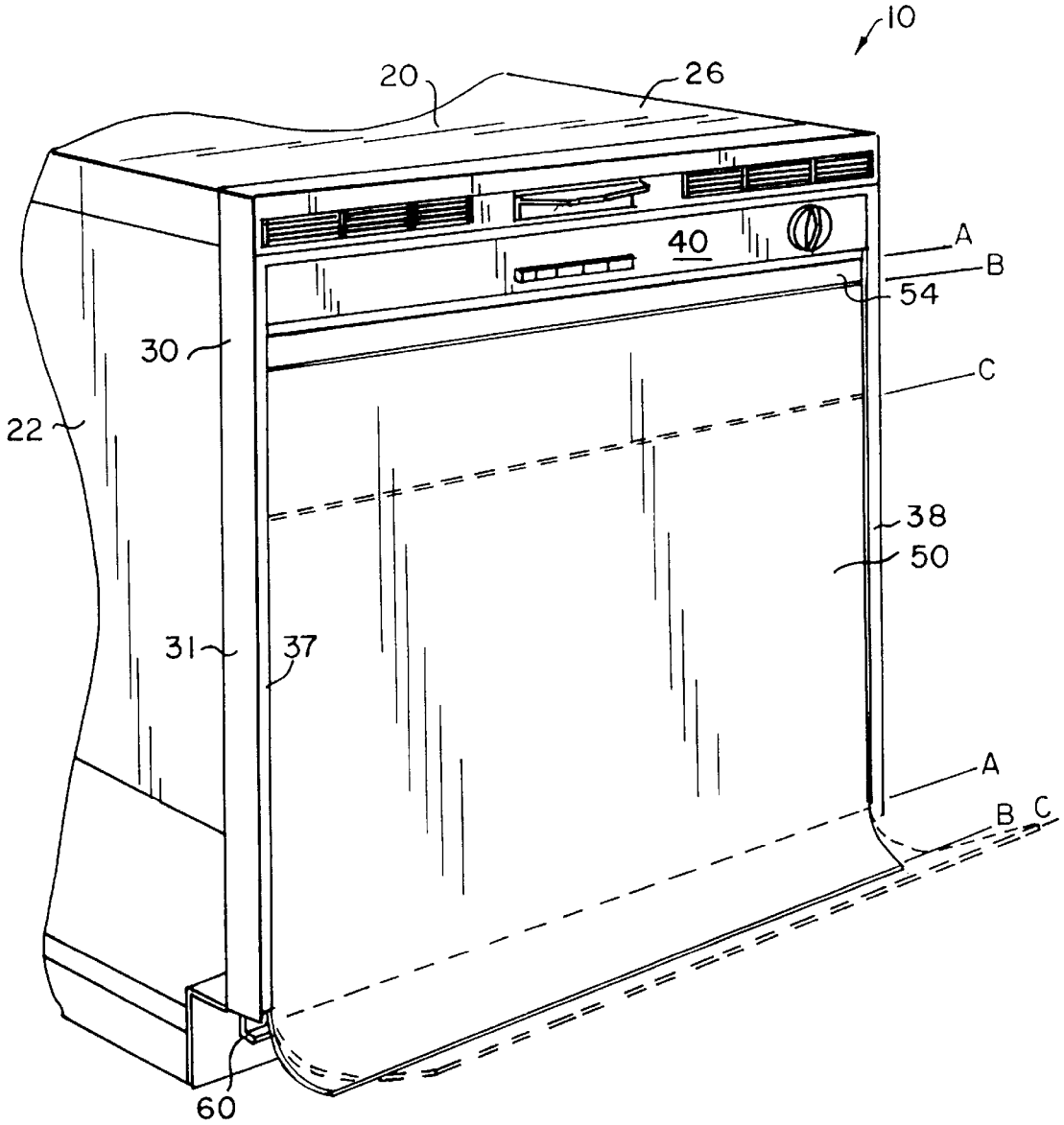
FIG. 5 illustrates the preferred embodiment dishwasher depicted in FIG. 1 during removal of a front decorator panel.

The decorator panel 50 is removed from the front of the dishwasher 10 as shown in FIG. 5. The trim piece 80 is removed so that the panel 50 can be slid or otherwise moved downward between the flanges 37 and 38. The panel 50 for instance, is moved from position A to position B by sliding downward to the floor or other surface. In doing so, the spacer panel 54 is exposed. The lower portion of the decorator panel 50 is then slightly bent or otherwise angled outward, away from the dishwasher, along a horizontal axis so that the panel 50 can be further slid downward between the flanges 37 and 38 to the position C as shown in FIG. 5. The panel 50 can then be easily removed from the front of the dishwasher door 30 by continuing this process.

Figure 6:
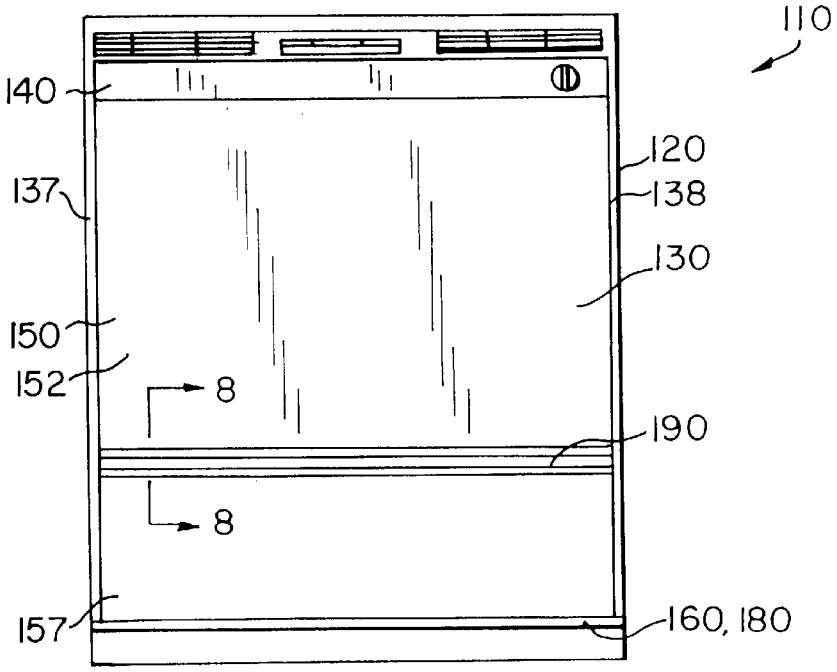
FIG. 6 is a second preferred embodiment dishwasher in accordance with the present invention, illustrating the use of a plurality of front decorator panels.

FIG. 6 illustrates a second preferred embodiment of the dishwasher door and panel assembly in accordance with the present invention. A dishwasher 110 is illustrated having an enclosure 120, a door 130, a console 140, a first decorator panel 150 having a front face 152, a lower decorator panel 157, a divider trim strip 190 separating the decorator panels 150 and 157, and a brace member 160 and a trim piece 180 assembly. The brace member 160 is affixed to the bottom periphery of the lower decorator panel 157 in the same manner as the brace member 60 is affixed to the bottom periphery of the panel 50 as previously described. The door 130 includes flanges 137 and 138 extending along respective sides of the door 130. The flanges 137 and 138 extend from the bottom portion or underside of the console 140 to the bottom portion of the lower decorator panel 157. The dishwasher 110 and noted components correspond to the previously described dishwasher 10 and its components. The divider trim strip 190 is preferably slidably retained between the flanges 137 and 138. The divider trim strip 190 is described in greater detail below.

Figure 7:
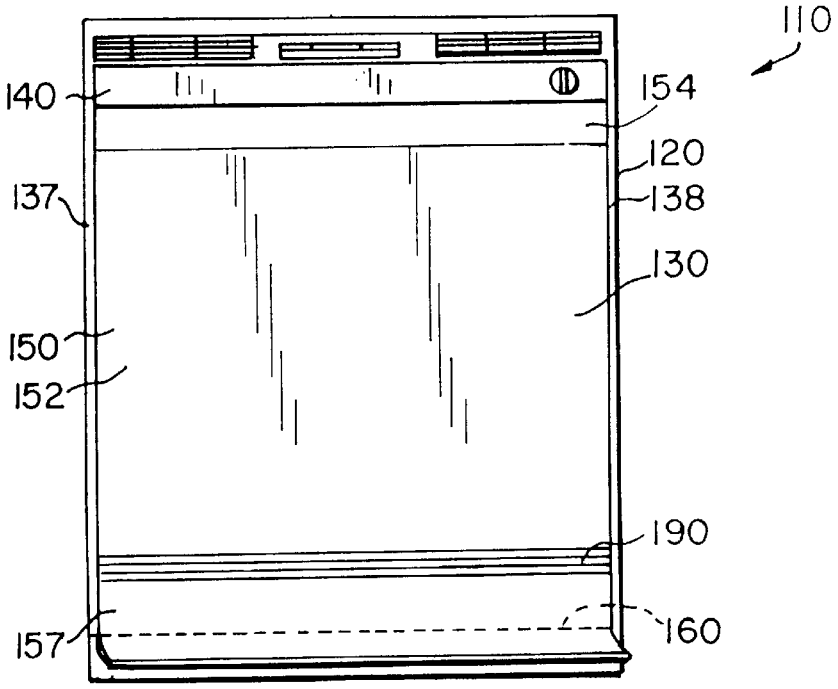
FIG. 7 illustrates the dishwasher shown in FIG. 6 during removal of the decorator panels.

FIG. 7 illustrates the dishwasher 110 depicted in FIG. 6 during removal of the decorator panels 150 and 157. In order to move the decorator panels 150 and 157 downward, the trim piece 180 is removed from its engagement with the brace member 160. The decorator panels 150 and 157 and the divider trim strip 190 are then slid downward between the flanges 137 and 138. This operation reveals an upper spacer panel 154. The lower decorator panel 157 is slightly bent along a horizontal axis if necessary so that it can be removed from the door 130. Once the lower decorator panel 157 is removed, the trim piece 190 is slid further downward from between the flanges 137 and 138 until it is free and can be removed. The upper decorator panel 150 can then be slid downward and removed in the same fashion as explained with regard to the panel 50 and illustrated in FIG. 5.

Figure 8:
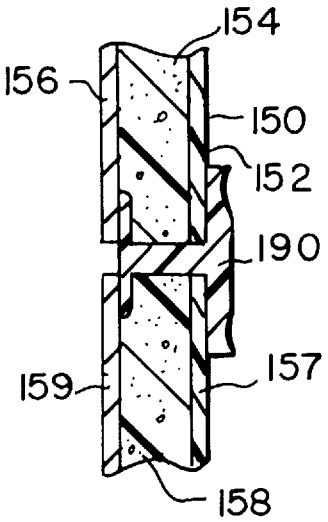
FIG. 8 is a partial cross-sectional view taken along line 8—8 in FIG. 6.

FIG. 8 illustrates a partial cross-section of the divider trim strip 190 and its engagement with the upper decorator panel 150 and the lower decorator panel 157. The decorator panel 150 provides a front face 152. Disposed behind the panel 150 on the opposite side of the decorator panel front face 152, are an upper spacer panel 154 and a middoor panel 156. Similarly, disposed behind the lower decorator panel 157 are a lower spacer panel 158 and a lower middoor panel 159. These panels correspond to the previously described decorator panel 50, the spacer panel 54, and the middoor panel 56, with the following exception. The upper spacer panel 154 and the lower spacer panel 158 are preferably not attached to the respective middoor panels 156 and 159. Instead, the upper and the lower spacer panels 154 and 158 are freely movable along the frontwardly directed faces of the middoor panels 156 and 159, respectively. This enables the assembly of both the upper and lower decorator panels 150 and 157, the divider trim strip 190, and the spacer panels 154 and 158 to move alongside the front of a door.

It will be understood that in all of the foregoing embodiments one or more other panels in addition to the decorator panels 50, 150, and 157, may be interchangeably disposed along the front of a door in the same fashion, i.e. by sliding upward and downward between opposing vertical flanges. These other panels may be removed simultaneously with the decorator panels, or removed separately before or after removal of the decorator panels. Examples of such other panels include spacer panels such as spacer panels 54, 154, and 158 and/or supplemental decorator panels. As previously noted, it may be desirable to include several decorator panels with the dishwasher. These other decorator panels could be stored along the front of the dishwasher door behind the decorator panel in use, i.e. displayed on the front of the door.

Although the present invention has been described in conjunction with a dishwasher, it is to be understood that the present invention decorator panel and retaining assembly can be utilized in a wide array of appliances in addition to dishwashers. Examples of such appliances include, but are not limited to ranges, ovens, microwave ovens, refrigerators, freezers, laundry washers, dryers, and trash compactors. Moreover, the present invention can be utilized along any wall of an appliance enclosure in addition to a door.

While the foregoing details what is felt to be the preferred embodiments of the invention, no material limitations to the scope of the claimed invention is intended. Further, features and design alternatives that would be obvious to one of ordinary skill in the art are considered to be incorporated herein. The scope of the invention as set forth is particularly described in the claims hereinbelow.

What is claimed is:

1. An appliance door and interchangeable panel assembly comprising:

a door frame having a first vertical member and a second vertical member oriented parallel to said first member;

a first flange disposed along at least a portion of said first member;

a second flange disposed along at least a portion of said second member;

a middoor panel extending between and affixed to said first member and said second member, said middoor panel defining an exposed lower edge extending between said first member and said second member;

a brace member affixed to said middoor panel and disposed proximate to said lower edge of said middoor panel;

a trim piece releasably engaging said brace member, said trim piece providing a support surface disposed forwardly from the brace member; and a decorator panel extending between said first flange and said second flange, and being disposed upon said trim piece along at least a portion of said support surface.

2. The assembly of claim 1 wherein said brace member comprises:

a first member;

a second member spaced from and generally parallel with said first member;

a third member spaced from and generally parallel with said second member, said third member disposed below said lower edge of said middoor panel;

a fourth member extending transversely between said first and said second member; and a fifth member extending transversely between said second and said third member.

3. The assembly of claim 2 wherein said brace member is affixed to said middoor panel along said fourth member.

4. The assembly of claim 1 further comprising a spacer panel disposed between said decorator panel and said middoor panel.

5. The assembly of claim 1 wherein said trim piece comprises:

a first leg;

a second leg spaced from and generally parallel with said first leg; and a rail member extending between said first and said second legs.

6. The assembly of claim 5 wherein said trim piece further comprises:

a raised detent disposed on said first leg, wherein said detent is spaced from said rail member thereby defining said support surface extending between said detent and said rail member.

7. The assembly of claim 1 further comprising:

a divider trim strip extending flange between said first flange and said second flange.

8. The assembly of claim 7 further comprising:

a second decorator panel disposed between said first flange and said second flange, wherein said divider trim strip is disposed below said second decorator panel.

9. A dishwasher having an interchangeable front panel assembly, said dishwasher comprising:

a front door including a first side member and a second side member oriented parallel to said first side member;

a middoor panel extending between and affixed to said first side member and said second side member, said middoor panel having an exposed lower edge;

a brace member affixed to said middoor panel and disposed proximate to said lower edge of said middoor panel;

a trim piece releasably engaging said brace member, said trim piece providing a support surface disposed forwardly from the brace member; and a decorator panel extending between said first side member and said second side member, and contacting said trim piece along at least a portion of said support surface.

10. The assembly of claim 9 wherein said brace member comprises:

an uppermost first member;

a second member spaced below and generally parallel with said first member;

a lowermost third member spaced below and generally parallel with said second member;

a fourth member extending transversely between said first member and said second member, said fourth member affixed to said middoor panel; and a fifth member extending transversely between said second member and said third member.

11. The assembly of claim 10 wherein said trim piece comprises:

a first leg;

a second leg spaced from and generally parallel with said first leg; and a rail member extending between said first leg and said second leg, wherein said trim piece is releasably engaged with said brace member by said third member of said brace member being disposed between said first leg and said second leg of said trim piece.

12. The assembly of claim 11 wherein said trim piece further comprises:

a raised detent disposed on said first leg, wherein said detent is spaced from said rail member thereby defining said support surface extending between said detent and said rail member.

13. The assembly of claim 9 further comprising:

a divider trim strip extending between said first side member and said second side member.

14. The assembly of claim 9 further comprising:

a spacer panel disposed between said decorator panel and said middoor panel.

15. The assembly of claim 9 wherein said decorator panel has a first face providing a first design, and a second face providing a second design, said second design different from said first design.

16. The assembly of claim 9 wherein said decorator panel has a first colored face and a second colored face, said color of said first face being different than said color of said second face.

* * * * *

UNITED STATES PATENT AND TRADEMARK OFFICE

CERTIFICATE OF CORRECTION

PATENT NO. : 5,806,942

DATED : September 15, 1998

INVENTOR(S) : Jenkins, Jr. et al.

It is certified that error appears in the above-identified patent and that said Letters Patent is hereby corrected as shown below:

Column 7, Line 46, Claim 7, delete "extending flange" and insert --extending--.

Signed and Sealed this

Twenty-ninth Day of December, 1998

*Attest:*

*Attesting Officer*

Bruce Lehman

BRUCE LEHMAN

*Commissioner of Patents and Trademarks*